US005633978A

United States Patent [19]

Hofsäss

[11] Patent Number: 5,633,978

[45] Date of Patent: May 27, 1997

[54] ELECTRICAL IMMERSION HEATER WITH REMOVABLE SELF-SUPPORTING CARRIER AND HOUSING

[76] Inventor: Marcel Hofsäss, Bodelschingstrasse 36, 75179 Pforzheim, Germany

[21] Appl. No.: 389,896

[22] Filed: Feb. 16, 1995

[30] Foreign Application Priority Data

Feb. 17, 1994 [DE] Germany ..... 44 05 040.2

[51] Int. Cl.[6] ..... H05B 3/78

[52] U.S. Cl. ..... 392/501; 219/544; 219/546

[58] Field of Search ..... 492/501; 219/544, 219/541, 530, 540, 546, 536, 504, 505, 523; 338/22 R

[56] References Cited

U.S. PATENT DOCUMENTS

| | | | |
|---|---|---|---|
| 4,091,267 | 5/1978 | Grant | 219/544 |
| 4,404,463 | 9/1983 | Eder et al. . | |
| 4,822,980 | 4/1989 | Carbone et al. | 219/315 |
| 5,270,521 | 12/1993 | Shikama et al. | 219/530 |

FOREIGN PATENT DOCUMENTS

| | | |
|---|---|---|
| 0026457 | 4/1981 | European Pat. Off. . |
| 3136094 | 5/1982 | Germany . |
| 2948592 | 11/1984 | Germany . |
| 257534 | 6/1988 | Germany . |

*Primary Examiner*—Teresa J. Walberg
*Assistant Examiner*—Thuy T. Dang
*Attorney, Agent, or Firm*—Harness, Dickey & Pierce, P.L.C.

[57] ABSTRACT

An electrical heater, in particular in the shape of an immersion heater (20), to heat liquids and/or keep these at a moderate temperature with at least one heating element which heats up on account of a current which flows through the element and which conveys heat to its surroundings. The at least one heating element is made of thermal ceramic and is housed in a thermally conductive, electrically insulated housing (11) with which it is in thermally conductive contact. The heating element is hereby clamped between two electrically conductive panels or plates through which the current is supplied, whereby a clamping device independent of the housing (11) is provided which presses the two plates and the heating element together. The cross-sections of the plates are provided with a matching bump and a depression so that the space between them can accommodate the heating element. At least one of the plates is provided with a raised area which protrudes beyond the clamping device and functions as a heat contact surface (FIG. 1).

10 Claims, 3 Drawing Sheets

ELECTRICAL IMMERSION HEATER WITH REMOVABLE SELF-SUPPORTING CARRIER AND HOUSING

FIELD OF THE INVENTION

The present invention relates to an electrical heater, in particular in the shape of an immersion heater, to heat liquids and/or keep these at a selected and/or moderate temperature, with at least one heating element which heats up on account of a current which flows through the element and which conveys heat to its surroundings, whereby the at least one heating element is made of thermal or heater ceramic and is housed in a thermally conductive, electrically insulated housing with which it is in thermally conductive contact, and the heating element is clamped between two electrically conductive panels or plates through which the current is supplied.

Such an electrical heater is known from the document DE-C-29 48 592.

BACKGROUND OF THE INVENTION

The known heater comprises a sleeve of thermally conductive silicone rubber in which two spaced guide channels are provided which extend into the rear part of the sleeve and each of which has a contact plate. A PTC heating element is clamped in the front area of the sleeve between the two contact plates which is supplied with electrical current via the two contact plates. The sleeve is closed by a holding body which simultaneously serves as a lead cleat for the feed lines leading to the contact plates.

This heater is designed as a heating cartridge and should be inserted in the device to be heated. Since the contact plates and the PTC heating element are completely surrounded by the sleeve and holding body the heat is transferred from the PTC heating element to the outside longitudinally and transversely to this sleeve so that the thermal yield from the PTC heating element to the object to be heated is determined by the thermal conduction in the silicone rubber and is thus unsatisfactory, which must be seen as a disadvantage.

A further disadvantage is the fact that the sleeve itself must be geometrically adapted to the dimensions of the PTC heating element used so that the resilient clamping of the PTC heating element between the smooth contact plates in the guide channels is sufficiently safe to ensure an adequate heat transfer from the PTC heating element to the contact plates. If the geometric dimensions of the PTC heating element change on account of manufacturing tolerances or special requirements on its output, a completely new sleeve has to be manufactured.

Immersion heaters with PTC heating elements clamped between heat conducting plates through which the electrical power is supplied are known from DE-A 31 36 094 and DE-B-26 14 433. The heat conducting plates of the PTC heating elements are inserted into a glass tube in such a way that the heat conducting plates carry voltage and thus make a good contact with the glass tube on the one hand and to the PTC heating element on the other.

On account of the limited temperatures which can be achieved with PTC heating elements on the one hand and the bad thermal conduction of glass on the other the external thermal yield with these known heaters is also unsatisfactory.

A heater with PTC heating element is also known from DD-C-257 534 in which the PTC heating element is clamped between two serpentine-shaped metal electrodes which serve both to supply the electrical current and carry off the heat.

In today's conventional electrical heaters, which in the widest sense of the word also include fan heaters, heat retaining plates, waffle irons, immersion heaters, heaters for foot baths, aquarium heaters, etc., heating spirals, spiral-wound filaments or other metallic resistance heaters are normally used as heating elements. The temperature yield of the heating elements is generally many hundreds of degrees C., spiral-wound filaments, for example, heat up to over 600° C. and more. On account of the increasing safety requirements a number of regulations now have to be observed by such heaters relating to both the electrical insulation to protect against electric shocks as well as the thermal insulation to protect against burns.

The heat is emitted either by radiation, whereby passing air is heated, or through thermal conduction, whereby the heating element is in contact with a thermally conductive surface, such as is the case with waffle irons.

The aquarium heaters mentioned, for example, often display an immersion body in the form of a glass rod with internal spiral-wound filament which can be inserted into the aquarium's water, whereby there is an air gap between the spiral-wound filament and the glass wall for safety reasons. On account of the bad heat transmission via this air gap and the bad thermal conduction of the glass the spiral-wound filament must be heated up to a very high temperature to ensure an adequate emission of heat to the water. A control loop with at least one probe is generally required for an exact temperature adjustment. Due to the necessarily great difference in temperature between the water and the spiral-wound filament on the one hand and the inertia of the overall system on the other its control is complicated and often has to be re-adjusted by hand. This is particularly undesirable since the adjustment and control mechanism is often located at the top of the glass rod and is immersed with this in the water so that the operator must reach into the water, whereby the fishes are often unwantedly disturbed.

These voluminous immersion heaters also often disturb the appearance of lovingly attended aquariums, though they do have the advantage that they can be retrofitted or replaced without having to change the landscape.

Other aquarium heaters are in the shape of a mat which function in the same way as an electric blanket and are placed on the floor/under the sand in the aquarium. Although they are supplied with 220 volts directly from the mains and are easier to control than the aforementioned glass rod heaters they also display a series of specific disadvantages.

The floor heater is firstly very expensive to construct and secondly requires a large surface area. Its replacement or retrofitting is very complicated, the fishes and the water firstly have to be emptied and the landscape removed to enable free access to the base of the aquarium.

On the whole, spiral-wound filaments also tend to burn out, e.g. as the result of high currents at make or mechanical vibrations when they are still hot, so that frequently the complete heater has to be replaced.

In view of this, an object of the present invention is to create a heater of the type mentioned at the outset which can be manufactured at low cost and is of a simple design whereby this should be such that the heater can be used for a number of applications and displays a good external thermal conduction.

SUMMARY OF THE INVENTION

In accordance with the invention this object is achieved by providing a clamping device independent of the housing which squeezes the plates and heating element together whereby the cross-sections of the plates are provided with a matching bump and a depression so that the space between them can accommodate the heating element and at least one of the plates is provided with an area which protrudes beyond the carrier and serves as a heat contact surface.

The problem on which the invention is based is thus completely solved. This is, as it were, an encapsulated resistance heater with a positive temperature coefficient which although it is electrically insulated against the housing still emits heat to the surroundings through the thermal conduction mechanism so that it can be directly immersed in a liquid in the manner of an immersion heater or aquarium heater. Since the heat is conveyed via thermal conduction and not radiation the new heater functions with a smaller difference in temperature between the heating element and the surrounding liquid so that it provides much more safety against burns than the heaters mentioned at the beginning.

Moreover, no soldering has to be carried out on the thermal ceramic itself so that the heat is also transferred via the plates, which means that no soldering joints are needed which would inhibit the heat transfer. This simultaneously facilitates installation.

The clamping device in accordance with the invention is on the one hand advantageous with respect to the easy installation, though it also guarantees a good heat transfer from the thermal ceramic to the plates.

The design of the plates' cross-section in accordance with the invention has the advantage that the distance between the plates is not determined solely by the thickness of the thermal ceramic since depending on how the plates are edged, greater distances can be made between the plates so that PTC heating elements with other dimensions can also be used, thus enabling not only a better electrical insulation between them but also increasing their flexibility in use. Assembly is also facilitated since the carrier can be designed in such way that the heating element cannot be lost.

The protruding area in accordance with the invention is also advantageous for a thermal conduction from the heating element to the outside via the corresponding plate.

The thermal ceramics used consist of mixtures of metal oxides, semi-conductive, sintered materials which give the thermal ceramic a high positive temperature coefficient. Such thermal ceramics are described in DIN 44081 and 44082, whereby these display a great increase in resistance in their nominal response temperature range with an increasing temperature. This is thus a safety element which cannot overheat on account of its construction and with which no overload current can be consumed. Rather, the temperature and the current control themselves via the temperature coefficient with a constant voltage. When the temperature rises the resistance of the thermal ceramic increases so that with a constantly applied voltage the ohmic losses converted into heat are reduced. However, if the thermal ceramic is cooled by heat dissipation the resistance drops and the ohmic losses once again rise, so that heating restarts. Consequently, the temperature to be set and the temperature sensitivity are preselected via the nominal response temperature, in whose range the great increase in resistance can be found, and via the size of the temperature coefficient. The nominal response temperatures can be found, for example, in the range from 60° C.–200° C.

Neither transformers nor controllers on the immersion body are necessary with such thermal ceramics, the temperature is largely determined by the preselected thermal ceramics. However, the maximum possible temperature can be reduced by reducing the transient current so that the temperature can be externally controlled, namely via a controller between the mains and the connecting line to the heating element. In the case of aquarium heaters, for example, it is not longer necessary to reach into the water to make adjustments.

Since only very small temperature ranges are often required, which may have to be switched in stages, such as is the case with heat retaining plates or aquarium heaters, the new heater is ideal for such applications. In an improved version a number of thermal ceramics can be switched in parallel or in series whereby it is possible to switch between various thermal ceramics with different nominal response temperatures using suitable mechanisms so that the new heater can be used for various operating conditions. Incidentally, damages such as burn outs in spiral-wound filaments do not occur.

The advantage of the new heater thus lies in the combination of the use of a thermal ceramic as a heating element and in the introduction of this heating element into an electrically insulating but thermally conductive housing which can be manufactured, for example, of industrial ceramic or suitable plastics.

Summing up, the advantages of the new heater thus lie in the fact that the external thermal yield is improved and at the same time the adaptability to various geometries of the heating element facilitated. Moreover, installation is also easier since once the plates have been inserted in the clamping device the PTC heating element can no longer fall out, something which is possible in the heater known from DE-C-29 48 592 when the contact plates provide inadequate clamping.

In a further embodiment it is preferred if the clamping device is designed as a self-supporting carrier in which the plates and the heating element are inserted under tension, whereby at least a part of the plates protrudes beyond the carrier.

The advantage here is that a compact unit for manufacturing can be produced whereby the external connections for electricity and the transfer of heat are guaranteed.

It is hereby preferable if the clamping device is made of a plastic with a high temperature resistance.

The advantage of this is that such plastics do not expand when heated so that the compression strength between the plates and the heating element and thus the good heat transmission are retained since the clamping device does not significantly expand when heated.

It is also preferable if the carrier has a counterpiece which interlocks with this in such a way that the plates and the heating element are held in a manner in which they cannot be lost.

The advantage of this is that such a unit is also suitable for forging manipulators. This unit can be used as a prefabricated "thermal mould" as a semi-finished product for various heater forms.

In this connection it is preferable if the carrier and/or the counterpiece are designed as a plug-type unit with grooves to guide and carry the plates.

The advantage here is that only the plates are inserted into the carrier and counterpiece so that the heating element between the plates is clamped firmly between these.

It is hereby preferable if terminal lugs are provided on the plates which protrude beyond the plug-type unit.

A subsequent switching of this so-called thermal mould is thus possible.

On the whole it is preferable if the plug-type unit is cast together with the clamped plates and the heating element in the housing, whereby the heat contact surfaces rest against the inside of the housing.

This measure is of particular advantage for manufacturing reasons since the plug-type unit can be cast with plastic, silicone, cold castable ceramic or other casting materials, all of which are thermally conductive but electrically insulating.

It is hereby preferable if clamping devices are provided which press the heat contact surfaces against the housing.

The advantage here is that this ensures a good heat transmission from the heat contact surface to the housing so that there is a very good thermal conduction from the thermal ceramic to the housing which then conveys the generated heat outwards.

It is also preferable if the plates are deep drawn.

This measure is advantageous for manufacturing reasons since deep-drawn plates are easy to manufacture.

Finally, it should be mentioned that due to the fact that all parts of the new heater are pressed against one another under mechanical stress in such a way that there is a good transmission of heat, the individual parts do not have to be manufactured with a high fitting accuracy, which not only cuts costs during manufacture but also enables simple assembly. Thermoconductive paste can be applied between the heating element and plates, plates and housing, etc., to improve the thermal conduction at the thermal bridges.

The housing, which can be manufactured for example of industrial ceramics, can be designed in the shape of a decorative stone, providing another appealing, optical advantage if one compares this to conventional aquarium heaters. On the other hand, the housing can easily be concealed beneath the sand in the aquarium whereby its installation is much easier than for the known base heaters.

The housing can alternatively be designed as a heat-retaining plate, used to keep meals warm. On account of the electrical insulation there are no safety misgivings in this case since even spilt food or liquids cannot penetrate the new heater and lead to a short-circuit.

Further fields of application are the same as for those heaters mentioned at the beginning. For example, it is also possible to integrate the new heater directly in a foot bath since there are no safety problems on account of the electrical insulation and small difference in temperature.

Further advantages can be derived from the description and enclosed drawing.

It is understood that the features named above and those still to be explained in the following can be used not only in the combinations mentioned but also in other combinations or alone without going beyond the scope of this present invention.

BRIEF DESCRIPTION OF THE DRAWINGS

The invention is shown in the drawings and will be explained in more detail in the following description. The drawings show.

DETAILED DESCRIPTION OF THE PREFERRED EMBODIMENT

Figure 1:
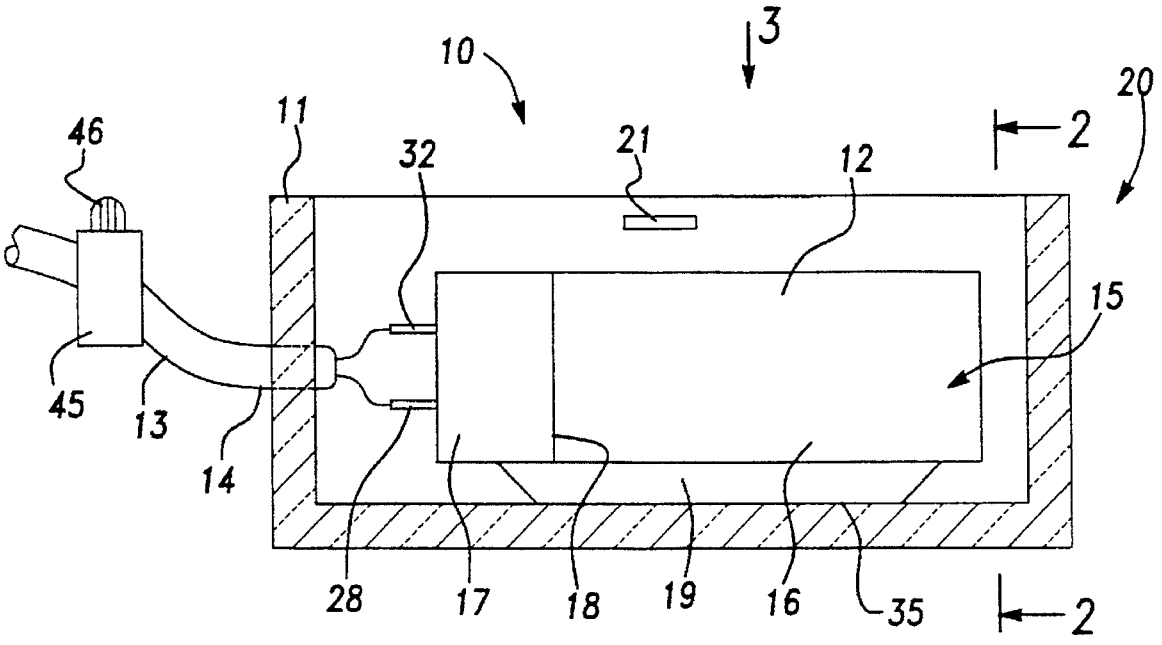
FIG. 1 an electrical heater according to the preferred embodiment of the present invention in a sectional side view along line I—I in FIG. 2.

FIG. 1 shows an electrical heater 10 according to the present invention in a sectional side view. The heater 10 comprises an electrically insulating though thermally conductive housing 11 made, for example, of industrial ceramics or a corresponding plastic. The housing 11 contains a compact unit consisting of an internal thermal mould 12 independent of the housing 11 which is supplied with electrical current via a supply cable 13. The supply cable 13 enters the inside of the housing 11 through a passage 14 which can be sealed with, for example, silicone where it is then connected to the internal thermal mould 12.

The thermal mould 12 is a sort of plug-type unit 15 consisting of a carrier 16 and a counterpiece 17 which can be separated from one another along a dividing line 18. This plug-type unit 15 is preferably manufactured of a thermally conductive though high-temperature resistant plastic.

A raised area 19 protrudes from beneath the plug-type unit 15 via which a heating element inside the thermal mould 12 makes thermally conductive contact with the housing 11 in a manner which will be described later.

The housing 11 is closed from above with a cover, not shown for reasons of clarity, so that it can be inserted as an immersion heater 20, e.g. to heat an aquarium or a foot bath.

Figure 2:
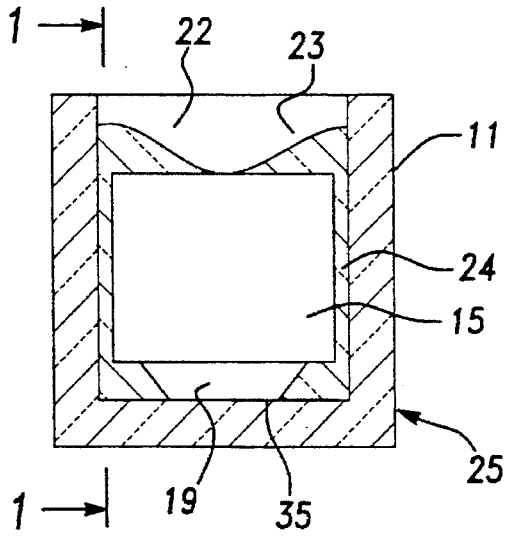
FIG. 2 the electrical heater from FIG. 1 in a sectional rear view along line II—II in FIG. 1.

Inside the housing 11 there is a seat 21 for a clamping device 22 in the form of a spiral spring 23 as shown in FIG. 2. This spiral spring 22 pushes the plug-type unit 15 as shown in FIG. 2 downwards so that the raised area 19 makes good thermally conductive contact with the inside of the housing 11. As indicated in FIG. 2 by reference numeral 24, the plug-type unit 15 is cast in the housing 11 with a casting material 24 which can be a plastic, silicone, cold castable ceramic or any other casting material which is thermally conductive yet electrically insulating. In this way the internal thermal mould 12 makes good thermally conductive contact with the inside of the housing 11 via the raised area 19 and casting material 24 so that the heat from the inside of the plug-type unit 15 can be conveyed to the surroundings via the outer surface 25 of the housing 11 with no great transmission losses. The heat transmission can be further improved through the use of thermoconductive paste.

Figure 3:
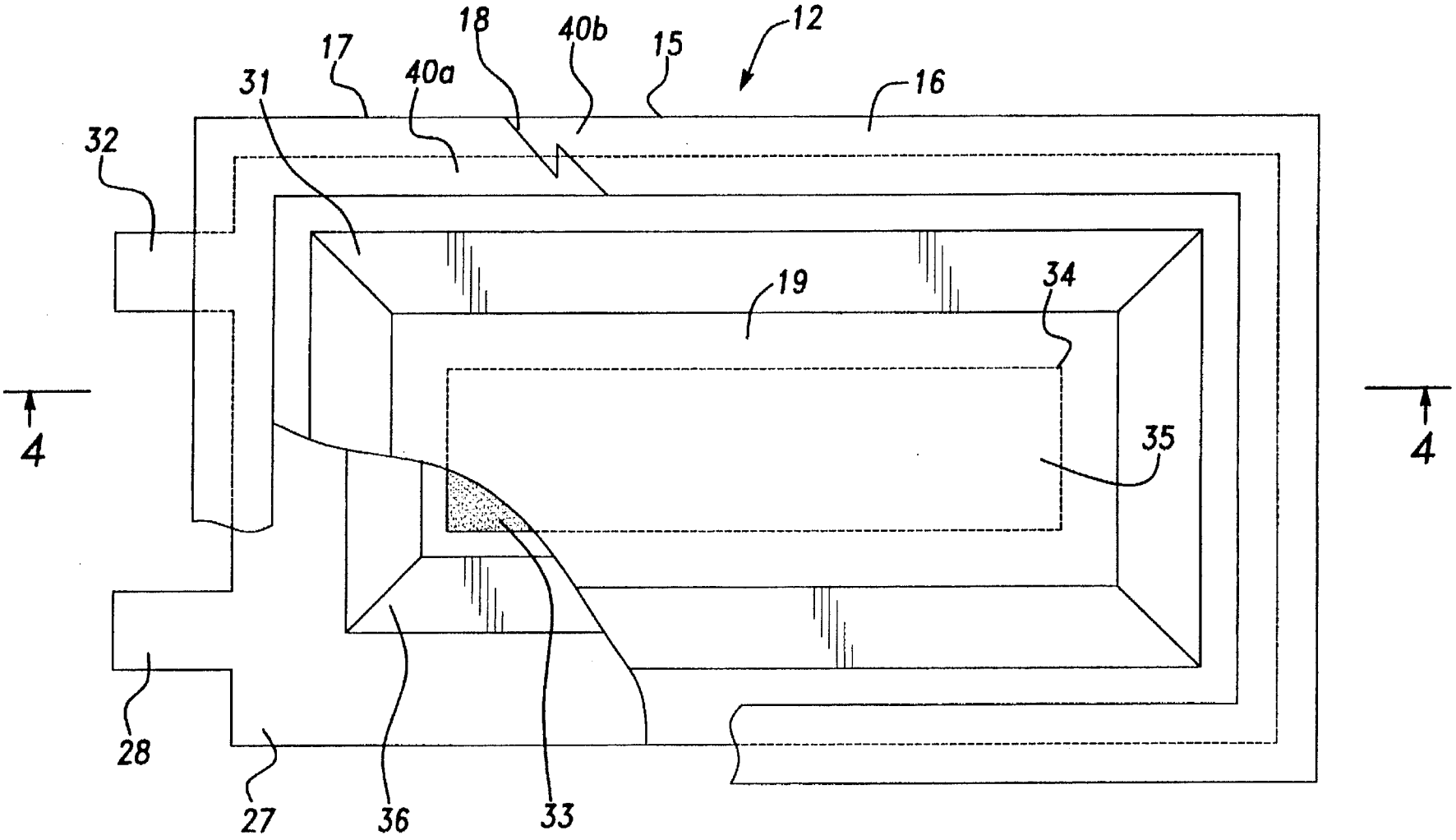
FIG. 3 the internal thermal mould of the heater according to FIG. 1 in a section along arrow III in FIG. 1.

FIG. 3 shows a top view of the thermal mould 12 from FIGS. 1 and 2 whereby areas of the plug-type unit 15 are broken away for greater clarity.

A lower, electrically conductive bottom plate 27 with terminal lug 28 and an upper electrically conductive top plate 31 with terminal lug 32 are clamped inside the plug-type unit 15. The terminal lugs 28 and 32 are offset both laterally and vertically, as can be seen by comparing FIGS. 1 and 3.

A heating element 33 made of thermal ceramic (posistor; PTC element) is clamped between the top plate 31 and the bottom plate 27 through which an electrical current is passed via the supply cable 13, terminal lugs 28 and 32 and plates 27 and 31. The heating element has a large positive temperature coefficient thus enabling adjustment to the set temperature determined by the nominal response temperature without this leading to overheating or a consumption of overload current as has already been explained in detail in the outset. If the heating element is used, for example, as an immersion heater, the nominal response temperature can be 120° C. If the water to be heated accidentally evaporates, in other words the immersion heater is "running dry", this does not overheat or consume overload current, so that safety is ensured at all times. In order to set a temperature lower than the nominal response temperature all that needs to be done is to reduce the strength of the current flow.

The top plate 31 has a raised area 19 whose underside is in thermally conductive contact with the heating element 33. The upper side 35 of the raised area 19 acts as a thermal contact surface via which the heat generated in the heating element 33 is transferred outwards through thermal conduction.

The bottom plate 27 also has a raised area 36 on which the heating element 33 is arranged. The heating element 33 on this bump 36 fits into the corresponding depression of the bump 19 from below, thus creating a retaining space 37 for the heating element 33, as can clearly be seen in the lateral sectional diagram in FIG. 4. The heating element 33 is held in this retaining space 37 in such a way that it cannot be lost.

Figure 4:
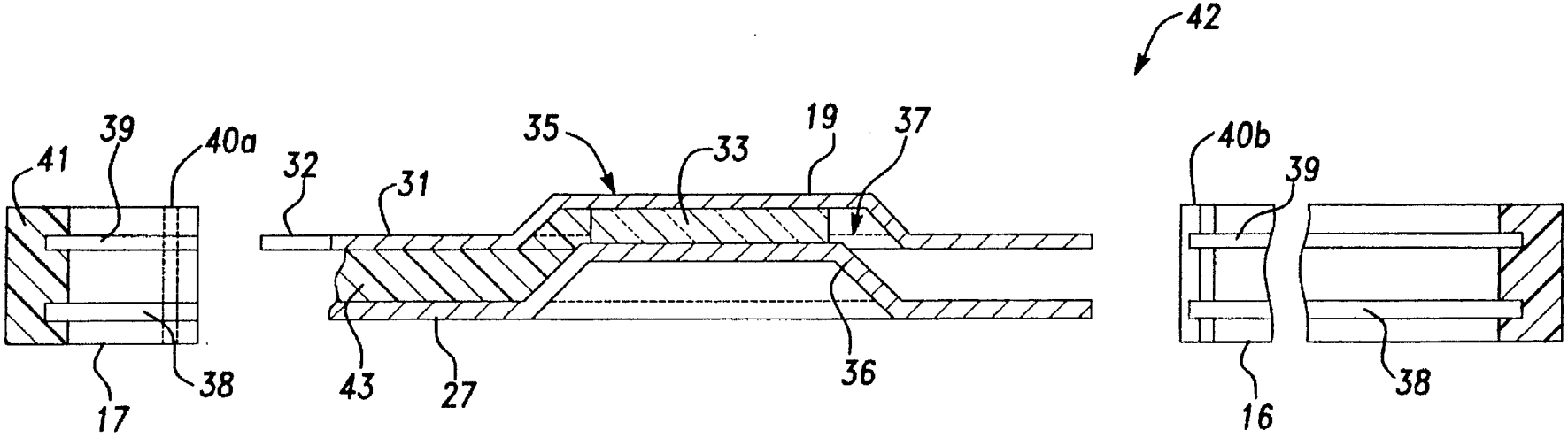
FIG. 4 a sectional exploded diagram along line IV—IV in FIG. 3.

In the exploded diagram of FIG. 4 the plug-type unit 15 is disassembled in such a way that the counterpiece 17 is located to the left of plates 27, 31 and the heating element 33 and the self-supporting carrier 16, which is partially broken, is to the right of these. It can be seen that the counterpiece 17 displays grooves 38 and 39 to guide plates 27 and 31. The distance between the grooves 38 and 39, which are, incidentally, also present in the self-supporting carrier 16, has been selected in such a way that the plates 27, 31 bearing the heating element 33 which are inserted between these grooves 38, 39 are pressed together in such a way that there is a very good heat transmission from the heating element 33 to the raised areas 19 and 36. Electricity is also supplied and carried off via these raised areas 19 and 36. The grooves 38 and 39 run U-shaped around the counterpiece 17 and the carrier 16 so that when the plug-type unit 15 is pushed together the plates 27, 31 and the heating element 33 clamped between these are held between these in such a way that they cannot be lost. Locking lugs 40*a* and 40*b* are provided on the carrier 16 and counterpiece 17 so that when the plug-type unit 15 is pushed together it locks tight.

In FIG. 4 it can also be seen that there is an opening 41 for the terminal lug 32 in the counterpiece 17. A similar opening is also provided for terminal lug 28 though this cannot be seen on account of the position of the section in FIG. 4.

Finally, it should be mentioned that the carrier 16 and counterpiece 17 create a clamping device 42 independent of the housing 11 which presses the plates 27 and 31 against the heating element 33.

In FIG. 4 it can be seen that the gap between the plates 27 and 31 in the area outside the pot-shaped raised areas 19 and 36 is larger than the thickness of the heating element 33, this being achieved through the selected edging of the plates 27 and 31. An insulating material 43 can be provided between plates 27 and 31 outside the heating element 33 to ensure a good insulation between these plates, this is indicated in FIG. 4 to the left of the heating element 33.

Finally, mention should also be made of a temperature controller 45 which is schematically indicated in FIG. 1 and which can be used as an optional extra if a lower temperature is desired than the nominal response temperature determined by the PTC heating element. In the most simple case the temperature controller 45 functions as current limiter which can be adjusted with the adjusting knob 46 and limits the current flowing through the heating element depending on the position of the adjusting knob 46, thus adjusting the heat-up temperature of the heating element to below the nominal response temperature.

I claim:

1. Electrical immersion heater, adapted to heat liquids and/or to keep these at a selected temperature, comprising a heating element made of a heater ceramic material, said heating element heating up in response to a current flowing therethrough and conveying heat to its surroundings, a thermally conductive, electrically insulated housing means housing said at least one heating element and being in thermally conductive contact with said heating element, two electrically conductive panels or plates clamping said at least one heating element therebetween, said current being supplied to said heating element via said panels or plates, said panels or plates being provided, in cross section, with a matching bump and a depression such that the space between said panels or plates can accommodate the heating element, and a clamping device independent from said housing and squeezing said panels or plates and said at least one heating element together, at least one of said panels or plates being provided with an area which protrudes beyond the clamping device and functions as a heat contact surface, wherein the clamping device is designed as a self-supporting carrier in which the plates are inserted under tension, whereby at least a part of the plates protrude beyond the carrier.

2. Heater according to claim 1, characterized in that the clamping device is made of a plastic with a high temperature resistance.

3. Heater according to claim 1, characterized in that the carrier has a centerpiece which interlocks with the carrier in such a way that the plates and the heating element are held in a manner in which they cannot be lost.

4. Heater according to claim 3, characterized in that the carrier and/or the counterpiece are designed as a plug-type unit with grooves to guide and carry the plates.

5. Heater according to claim 1, characterized in that terminal lugs are provided on the plates which protrude beyond the clamping device.

6. Heater according to claim 1, characterized in that the clamping device is cast together with the clamped plates and the heating element in the housing, whereby the heat contact surface rests against the inside of the housing.

7. Heater according to claim 6, characterized in that clamping means are provided which press the heat contact surface against the housing.

8. Heater according to claim 1, characterized in that the plates are deep drawn.

9. Electrical immersion heater, adapted to heat liquids and/or to keep these at a selected temperature, comprising a heating element made of a heater ceramic material, said heating element heating up in response to a current flowing therethrough and conveying heat to its surroundings, a thermally conductive, electrically insulated housing means housing said at least one heating element and being in thermally conductive contact with said heating element, two electrically conductive panels or plates clamping said at least one heating element therebetween, said current being supplied to said heating element via said panels or plates, said panels or plates being provided, in cross-section, with a matching bump and a depression such that the space between said panels or plates can accommodate the heating element, a clamping device independent from said housing and squeezing said panels or plates and said at least one heating element together, at least one of said panels or plates being provided with an area which protrudes beyond the clamping device and functions as a heat contact surface, and wherein the plates are deep drawn.

10. Heater according to claim 9, characterized in that the clamping device is designed as a self-supporting carrier in which the plates are inserted under tension, whereby at least a part of the plates provides beyond the carrier.

* * * * *

UNITED STATES PATENT AND TRADEMARK OFFICE

CERTIFICATE OF CORRECTION

PATENT NO. : 5,633,978

DATED : May 27, 1997

INVENTOR(S) : Marcel Hofsäss

It is certified that error appears in the above-indentified patent and that said Letters Patent is hereby corrected as shown below:

Column 3, line 4,
before "plates", insert --panels or--.

Column 5, line 64,
after "invention", insert --without the clamping device and casting material--.

Column 6, line 53 ,
before "plate", insert --panel or--.

Column 6, line 55,
before "plate", insert --panel or--.

Column 8, lines 7 - 8, claim 1,
after "heat", insert --or maintain-- and delete "and/or to keep these".

Column 8, line 14, claim 1,
delete "at least one".

Column 8, line 18, claim 1,
delete "at least one".

Column 8, lines 22 - 23, claim 1,
delete "can accommodate" and insert --accommodates--.

Column 8, line 25, claim 1,
delete "at least one".

UNITED STATES PATENT AND TRADEMARK OFFICE

CERTIFICATE OF CORRECTION

PATENT NO. : 5,633,978

DATED : May 27, 1997

INVENTOR(S) : Marcel Hofsäss

It is certified that error appears in the above-indentified patent and that said Letters Patent is hereby corrected as shown below:

Column 8, line 30, claim 1,
before "plates", insert --panels or--.

Column 8, line 31, claim 1,
before "plates", insert --panels or--.

Column 8, lines 34 - 35, claim 2,
delete "with a high temperature resistance".

Column 8, line 38, claim 3,
before "plates", insert --panels or--.

Column 8, lines 38 - 39, claim 3,
delete "held in a manner in which they cannot be lost" and insert --secured by the carrier and counterpiece--.

Column 8, line 41, claim 4,
delete "and/or" and insert --and--.

Column 8, line 42, claim 4,
before "plates", insert --panels or--.

Column 8, line 44, claim 5,
before "plates", insert --panels or--.

Column 8, line 47, claim 6,
before "plates", insert --panels or--.

UNITED STATES PATENT AND TRADEMARK OFFICE

CERTIFICATE OF CORRECTION

PATENT NO. : 5,633,978

DATED : May 27, 1997

INVENTOR(S) : Marcel Hofsäss

It is certified that error appears in the above-indentified patent and that said Letters Patent is hereby corrected as shown below:

Column 8, line 53, claim 8,
before "plates", insert --panels or--.

Column 8, lines 55 - 56, claim 9,
after "heat", insert --or maintain-- and delete "and/or to keep these".

Column 8, line 62, claim 9,
delete "at least one".

Column 8, line 66, claim 9,
delete "at least one".

Column 9, lines 4 - 5, claim 9,
delete "can accommodate" and insert --accommodates--.

Column 9, line 7, claim 9,
delete "at least one".

Column 10, line 2, claim 9,
before "plates", insert --panels or--.

Column 10, line 5, claim 10,
before "plates", insert --panels or--.

Column 10, line 6, claim 10,
before "plates", insert --panels or--.

UNITED STATES PATENT AND TRADEMARK OFFICE

CERTIFICATE OF CORRECTION

PATENT NO. : 5,633,978

DATED : May 27, 1997

INVENTOR(S) : Marcel Hofsäss

It is certified that error appears in the above-indentified patent and that said Letters Patent is hereby corrected as shown below:

Column 10, line 6, claim 10,
"provides" should be --protrudes--.

Signed and Sealed this

Nineteenth Day of May, 1998

Bruce Lehman

*Attest:*

BRUCE LEHMAN

*Attesting Officer*

*Commissioner of Patents and Trademarks*